United States Patent [19]

Kato et al.

[11] Patent Number: 4,929,526

[45] Date of Patent: May 29, 1990

[54] ELECTROPHOTOGRAPHIC LITHOGRAPHIC PRINTING PLATE PRECURSOR

[75] Inventors: Eiichi Kato; Kazuo Ishii; Ryosuke Itakura; Hidefumi Sera, all of Shizuoka, Japan

[73] Assignee: Fuji Photo Film Co., Ltd., Kanagawa, Japan

[21] Appl. No.: 319,895

[22] Filed: Mar. 7, 1989

Related U.S. Application Data

[63] Continuation of Ser. No. 17,408, Feb. 24, 1987, abandoned.

[30] Foreign Application Priority Data

Feb. 24, 1986 [JP] Japan ..... 61-37321
Mar. 12, 1986 [JP] Japan ..... 61-52364

[51] Int. Cl.[5] ..... G03G 5/087

[52] U.S. Cl. ..... 430/87; 430/49; 430/96

[58] Field of Search ..... 430/87, 96, 49, 78

[56] References Cited

U.S. PATENT DOCUMENTS 4,792,511 12/1988 Kato et al. ..... 430/49

*Primary Examiner*—John L. Goodrow
*Attorney, Agent, or Firm*—Sughrue, Mion, Zinn, Macpeak & Seas

[57] ABSTRACT

An electrophotographic lithographic printing plate precursor obtained from an electrophotographic photoreceptor comprising a conductive support having provided thereon at least one photoconductive layer containing photoconductive zinc oxide and a resin binder, wherein said resin binder comprises a resin containing at least one functional group capable of forming at least one hydroxyl group upon being decomposed. The printing plate precursor exhibits high image reproducibility, stain resistance, and green preservability, and a printing plate obtained therefrom has high resistance to background stain and has printing durability.

54 Claims, No Drawings

ELECTROPHOTOGRAPHIC LITHOGRAPHIC PRINTING PLATE PRECURSOR

This is a continuation of application Ser. No. 07,/017,408 filed Feb. 24, 1987, now abandoned.

FIELD OF THE INVENTION

This invention relates to an electrophotographic lithographic printing plate precursor, and more particularly, to the use of a special resin binder forming a photoconductive layer of a lithographic printing plate precursor.

BACKGROUND OF THE INVENTION

A number of offset printing plate precursors for directly producing printing plates have hitherto been proposed, and some of them have already been put into practical use. Widely employed among them is a system in which a photoreceptor comprising a conductive support having provided thereon a photoconductive layer mainly comprising photoconductive particles, e.g., zinc oxide, and a resin binder is subjected to an ordinary electrophotographic processing to form a highly lipophilic toner image thereon, followed by treating the surface of the photoreceptor with an oil-desensitizing solution referred to as an etching solution, to selectively render non-image areas hydrophilic and thus obtain an offset printing plate.

Requirements of offset printing plate precursors for obtaining satisfactory prints include: (1) an original should be reproduced faithfully on the photoreceptor; (2) the surface of a photoreceptor has affinity with an oil desensitizing solution so as to render non-image areas sufficiently hydrophilic, but, at the same time, has resistance to solubilization; and (3) a photoconductive layer having an image formed thereon is not released during printing and is well receptive to moistening water so that the non-image areas retain the hydrophilic properties sufficiently to be free from stains even upon printing a large number of prints.

It is known that these performance properties of the printing plate precursors are influenced by the ratio of zinc oxide to resin binder in the photoconductive layer. For example, as the ratio of resin binder to zinc oxide particles becomes small, oil-desensitivity of the surface of the photoconductive layer is increased to reduce background stains but, in turn, the internal cohesion of the photoconductive layer per se is weakened, resulting in reduction of printing durability due to insufficient mechanical strength. On the other hand, as the proportion of the resin binder increases, printing durability is improved, while background staining becomes conspicuous. With respect to background staining, while it is a phenomenon associated with the degree of oil-desensitization achieved, it has been elucidated that the oil-desensitization of the photoconductive layer surface depends not only on the zinc oxide/resin binder ratio in the photoconductive layer, but also depends greatly on the kind of the resin binder used.

Resin binders which have been conventionally known include silicone resins (see Japanese Patent Publication No. 6670/59), styrene-butadiene resins (see Japanese Patent Publication No. 1960/60), alkyd resins, maleic acid resins, polyamides (see Japanese Patent Publication No. 11219/60), vinyl acetate resins (see Japanese Patent Publication No. 2425/66), vinyl acetate copolymer resins (see Japanese Patent Publication No. 2426/66), acrylic resins (see Japanese Patent Publication No. 11216/60), acrylic ester copolymer resins (see Japanese Patent Publication Nos. 11219/60, 8510/61, and 13946/66), etc. However, electrophotographic light-sensitive materials using these known resins suffer from one or more of several disadvantages, such as low charging characteristics of the photoconductive layer, poor quality of a reproduced image (particularly dot reproducibility or resolving power), low sensitivity to exposure; insufficient oil-desensitization attained by oil-desensitization for use as an offset master (which results in background stains on prints when used for offset printing), insufficient film strength of the light-sensitive layer (which causes release of the light-sensitive layer during offset printing and failure to obtain a large number of prints), susceptibility of image quality to influences of environment at the time of electrophotographic image formation (such as high temperature and high humidity), and the like.

For particular use as an offset printing plate precursor, formation of background stains due to insufficient oil-desensitivity presents a serious problem. In order to solve this problem, various resins as binders for zinc oxide have been proposed, including a resin having a molecular weight of from $1.8\times104$ to $1.0\times104$ and a glass transition point of from 10 to 80° C., obtained by copolymerizing a (meth)acrylate monomer and a copolymerizable monomer in the presence of fumaric acid in combination with a copolymer of a (meth)acrylate monomer and a copolymerizable monomer other than fumaric acid as disclosed in Japanese Patent Publication No. 31011/75; a terpolymer containing a (meth)acrylic ester unit having a substituent having a carboxylic group at least 7 atoms distant from the ester linkage as disclosed in Japanese Patent Application (OPI) No. 54027/78 (the term "OPI" as used herein means "unexamined published application"); a tetra- or pentamer containing an acrylic acid unit and a hydroxyethyl (meth)acrylate unit as disclosed in Japanese Patent Application (OPI) Nos. 20735/79 and 202544/82; a terpolymer containing a (meth)acrylic ester unit having an alkyl group having from 6 to 12 carbon atoms as a substituent and a vinyl monomer containing a carboxylic acid group as disclosed in Japanese Patent Application (OPI) No. 68046/83; and the like.

Nevertheless, evaluations of such resins as noted above for improving oil-desensitization indicate that none of them is completely satisfactory in terms of stain resistance, printing durability, and the like.

SUMMARY OF THE INVENTION

One object of this invention is to provide a lithographic printing plate precursor which reproduces an image faithful to an original, forms neither background stains evenly over the entire surface nor dot-like stains, and exhibits excellent oil-desensitization.

Another object of this invention is to provide a lithographic printing plate which maintains sufficient hydrophilic properties on its non-image areas so as to have stain resistance and high printing durability even when used for printing a large number of prints.

A further object of this invention is to provide a lithographic printing plate precursor which forms a high quality image and does not cause background stains irrespective of variation of environmental conditions of electrophotographic processing, such as temperature and humidity.

A still further object of this invention is to provide a lithographic printing plate precursor having excellent green (before use) preservability.

It has now been found that the above objects can be accomplished by an electrophotographic lithographic printing plate precursor obtained from an electrophotographic photoreceptor comprising a conductive support having provided thereon at least one photoconductive layer containing photoconductive zinc oxide and a resin binder, wherein said resin binder comprises a resin containing at least one functional group per molecular thereof capable of forming at least one hydroxyl group upon being decomposed.

DETAILED DESCRIPTION OF THE INVENTION

The resin used in accordance with the present invention as a binder contains at least one functional group capable of forming one or more hydroxyl groups upon being decomposed (hereinafter sometimes referred to as the "hydroxyl-forming functional group-containing resin").

In a preferred embodiment of the invention, the aforesaid resin contains at least one functional group per molecule thereof represented by formula (I)

$$-O-L \qquad (I)$$

wherein L represents $$-\overset{\overset{R_1}{|}}{\underset{\underset{R_3}{|}}{Si}}-R_2,\ -CO-Y_1,\ -CO-Z-Y_2,\ -CH=CH-CH_3,$$

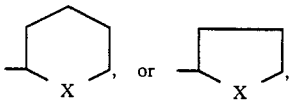

wherein $R_1$, $R_2$, and $R_3$ (which may be the same or different) each represents a hydrogen atom, a hydrocarbon group, or —O—R′, wherein R′ represents a hydrocarbon group; X represents a sulfur, atom or an oxygen atom; $Y_1$ and $Y_2$ each represents a hydrocarbon group; and Z represents an oxygen atom, a sulfur atom, or —NH—.

In formula (I), $R_1$, $R_2$, and $R_3$ each preferably represents a hydrogen atom, a substituted or unsubstituted straight chain or branched chain alkyl group having from 1 to 18 carbon atoms (e.g., a methyl group, an ethyl group, a propyl group, a butyl group, a hexyl group, an octyl group, a decyl group, a dodecyl group, an octadecyl group, a chloroethyl group, a methoxyethyl group, a methoxypropyl group, etc.), a substituted or unsubstituted alicyclic group (e.g., a cyclopentyl group, a cyclohexyl group, etc.), a substituted or unsubstituted aralkyl group having from 7 to 12 carbon atoms (e.g., a benzyl group, a phenethyl group, a chlorobenzyl group, a methoxybenzyl group, etc.), a substituted or unsubstituted aryl group (e.g., a phenyl group, a naphthyl group, a chlorophenyl group, a tolyl group, a methoxyphenyl group, a methoxycarbonylphenyl group, a dichlorophenyl group, etc.), or —O—R′ wherein R′ is as defined above, and more specifically includes hydrocarbon groups as in the case of $R_1$, $R_2$, an $R_3$.

$Y_1$ and $Y_2$ each preferably represents a substituted or unsubstituted straight chain or branched chain alkyl group having from 1 to 6 carbon atoms (e.g., a methyl group, a trichloromethyl group, a trifluoromethyl group, a methoxymethyl group, a phenoxymethyl group, a 2,2,2-trifluoroethyl group, a t-butyl group, a hexafluoroisopropyl group, etc.), a substituted or unsubstituted aralkyl group having from 7 to 9 carbon atoms (e.g., a benzyl group, a phenethyl group, a methylbenzyl group, a trimethylbenzyl group, a heptamethylbenzyl group, a methoxybenzyl group, etc.), or a substituted or unsubstituted aryl group having from 6 to 12 carbon atoms (e.g., a phenyl group, a nitrophenyl group, a cyanophenyl group, a methanesulfonylphenyl group, a methoxyphenyl group, a butoxyphenyl group, a chlorophenyl group, a dichlorophenyl group, a trifluoromethylphenyl group, etc.).

The resin containing at least one of the functional groups represented by formula (I) can be prepared by a Process (A) comprising converting a hydroxyl group of a polymer into the functional group of formula (I) through a. polymeric reaction, or a Process (B) comprising polymerizing at least one monomer containing at least one functional group of formula (I) or copolymerizing such a monomer with other copolymerizable monomers.

For details of the above-noted polymeric reaction, reference can be made, e.g., to Y. Iwakura and K. Kurita, *Hannosei Kobunshi, p.* 158, Kodansha. Conversion of a hydroxyl group of a monomer into the functional group of formula —O—L can be carried out by a process described, e.g., in Nihon Kagakukai (ed.), *Shin-Jikken Kagaku Koza,* Vol. 14, "Yuki Kagobutsu no Gose to Han-no (V)", p. 2497, Maruzen K.K.

Process (B) is preferred to Process (A) because the former process allows for arbitrary control the functional group —O—L content and allows no incorporation of impurities. In more detail, according to Process (B), a hydroxyl group(s) of a compound containing a polymerizable double bond and at least one hydroxyl group is(are) converted to any of the functional groups of formula (I), and the resulting functional group-containing compound is polymerized, or a compound containing at least one of the functional group of formula (I) is reacted with a compound having a polymerizable double bond.

The monomer compound containing the functional group —O—L which can be used in Process (B) specifically include those represented by formula (II)

$$\overset{a_1}{\overset{|}{CH}}=\overset{a_2}{\overset{|}{C}}-X'-Y'-O-L \qquad (II)$$

wherein X′ represents $$-O-,\ -CO-,\ -COO-,\ -OCO-,\ -\overset{\overset{Q_1}{|}}{N}CO-,\ -CO\overset{\overset{Q_2}{|}}{N}-,$$

$$-SO_2-,\ -SO_2\overset{\overset{Q_3}{|}}{N}-,\ -\overset{\overset{Q_4}{|}}{N}SO_2-,\ -CH_2COO-,\ \left(\overset{\overset{b_1}{|}}{\underset{\underset{b_2}{|}}{C}}\right)_n,$$

an aromatic group, or a heterocyclic group, wherein $Q_1$, $Q_2$, $Q_3$, and $Q_4$ each represents a hydrogen atom, a hydrocarbon group, or the group —Y′—O—L in formula (II); $b_1$ and $b_2$ (which may be the same or different)

each represents a hydrogen atom, a hydrocarbon group, or the group —Y'—O—L in formula (II); and n represents an integer of from 0 to 18; Y' represents a carbon-carbon bond for linking X' and —O—L, which may contain a hetero atom (e.g., an oxygen atom, a sulfur atom, or a nitrogen atom); L is as defined above; and $a_1$ and $1_2$ (which may be the same or different) each represents a hydrogen atom, a hydrocarbon group (e.g., an alkyl group having from 1 to 12 carbon atoms, which may be substituted with a hydroxyl group, etc.), a hydroxyl group, or —COO—W, wherein W represents an alkyl, alkenyl, aralkyl, alicyclic, or aromic group having from 1 to 18 carbon atoms, which may be substituted with a group containing the group —O—L.

In formula (II), the linking group as represented by

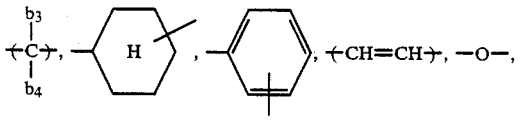

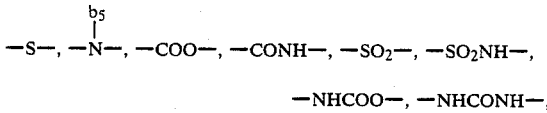

etc., or a combination thereof, wherein $b_3$, $b_4$, and $b_5$ each has the same meaning as $b_1$ and $b_2$.

Specific but non-limitative examples of the monomer compounds represented by formula (II) below, i.e., (1)

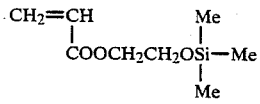

(2)

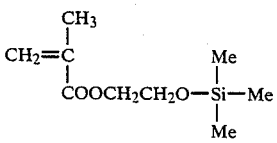

(3)

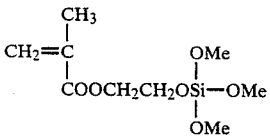

(4)

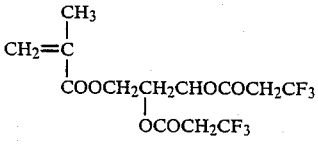

(5)

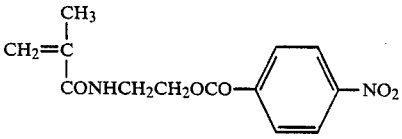

(6)

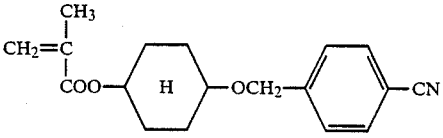

-continued (7)

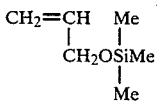

(8)

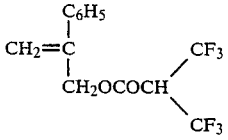

(9)

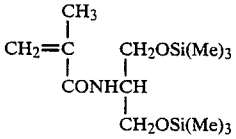

(10)

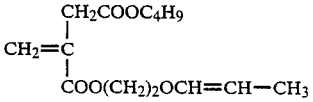

(11)

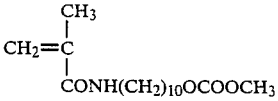

(12)

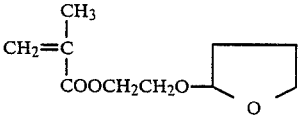

(13)

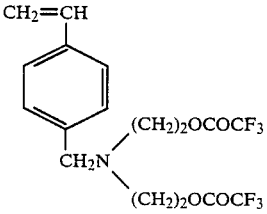

(14)

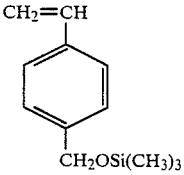

(15)

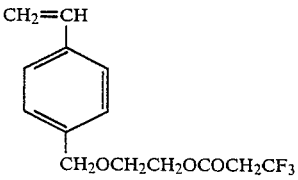

(16)

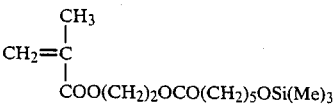

(17)

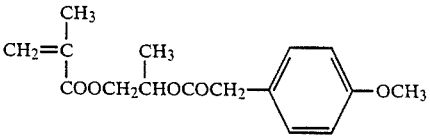

-continued

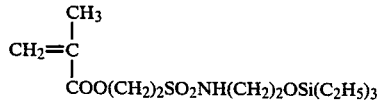

(18)

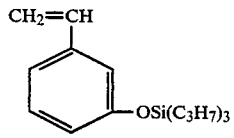

(19)

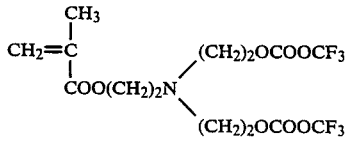

(20)

wherein Me represents a methyl group.

As previously described, these monomers may be either homopolymerized or copolymerized with other copolymerizable monomers. Examples of the comonomers to be used include vinyl or allyl esters of aliphatic carboxylic acids, e.g., vinyl acetate, vinyl propionate, vinyl butyrate, allyl acetate, allyl propionate, etc.; esters or amides of unsaturated carboxylic acids, e.g., acrylic acid, methacrylic acid, crotonic acid, itaconic acid, maleic acid, fumaric acid, etc.; styrene derivatives, e.g., styrene, vinyltoluene, α-methylstyrene, etc.; α-olefins; acrylonitrile, methacrylonitrile; vinyl-substituted heterocyclic compounds, e.g., N-vinylpyrrolidone, etc.; and the like.

When the resin containing the functional group of formula —O—L is a copolymer comprising a monomer containing the functional group —O—L, the content of such a monomer ranges from 0.5 to 99.5% by weight, and preferably from 1 to 99% by weight, based on the total weight of the copolymer. The polymer resin according to this embodiment has a molecular weight of from $10^3$ to $10^6$, and preferably from $5\times10^3$ to $5\times10^5$.

In another preferred embodiment according to the present invention, the hydroxyl-forming functional group-containing resin is a resin containing at least one functional group in which at least two hydroxyl groups spaced sterically close together are protected with one protective group.

Examples of such a functional group are those represented by formulae (III), (IV), and (V) shown below.

Formula (III) is represented by

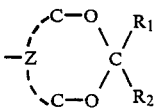

(III)

wherein $R_1$ and $R_2$ (which may be the same or different) each represents a hydrogen atom' a hydrocarbon group, or —O—R', wherein R' represents a hydrocarbon group; and Z represents

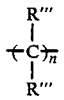

wherein R''' may be the same or different and represents a hydrogen atom or a hydrocarbon group and n is an integer of 1, 2 or 3; or a linking group composed of at least one

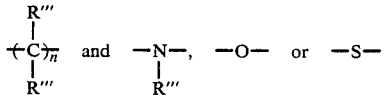

wherein R''' is as defined above, provided that the number of atoms existing between the two oxygen atoms in the formula does not exceed 5.

Formula (IV) is represented by

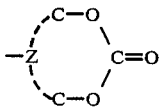

(IV)

wherein Z is the same as defined above.

Formula (V) is represented by

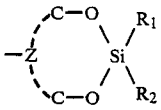

(V)

wherein $R_1$, $R_2$, and Z are the same as defined above.

In formulae (III), (IV), and (V), R and $R_2$ (which may be the same or different) each preferably represents a hydrogen atom, a substituted or unsubstituted alkyl group having from 1 to 12 carbon atoms (e.g., a methyl group, an ethyl group, a propyl group, a butyl group, a hexyl group, a 2-methoxyethyl group, an octyl group, etc.), a substituted or unsubstituted aralkyl group having from 7 to 9 carbon atoms (e.g., a benzyl group, a phenethyl group, a methylbenzyl group, a methoxybenzyl group, a chlorobenzyl group, etc.), an alicyclic group having from 5 to 7 carbon atoms (e.g., a cyclopentyl group, a cyclohexyl group, etc.), a substituted or unsubstituted aryl group (e.g., a phenyl group, a chlorophenyl group, a methoxyphenyl group, a methyl phenyl group, a cyanophenyl group, etc.), or —O—R', wherein R' has the same meaning as the hydrocarbon groups as represented by $R_1$ and $R_2$.

The resin containing at least one of the above described functional groups of formulae (III) to (V) can be prepared by Process (C) comprising protecting two hydroxyl groups of a polymer being positioned sterically close together with a protective group by a polymeric reaction, or Process (D) comprising polymerizing at least one of monomers containing two hydroxyl groups positioned sterically close together which have previously been protected with a protective group or copolymerizing such a monomer with other copolymerizable monomers.

The starting polymer having two hydroxyl groups spaced close together which can be used in Process (C) comprises a repeating unit having two hydroxyl groups close to each other or a repeating unit capable of providing two hydroxyl groups spaced close together upon polymerization. Specific examples of such a repeating unit are

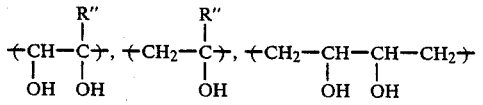

wherein R″ represents a hydrogen atom or a substituent, e.g., a methyl group, etc.

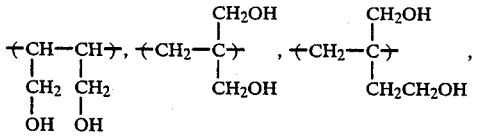

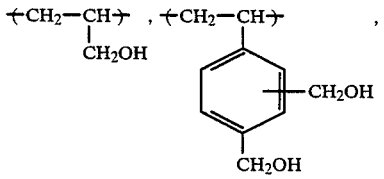

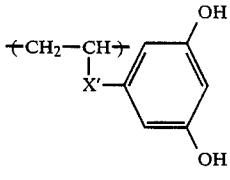

wherein X′ represents a linking group.

According to Process (C), a polymer having these repeating units is reacted with a compound, such as carbonyl compounds, ortho-ester compounds, halogen-substituted formic esters, dihalogen-substituted silyl compounds, etc., to thereby form functional groups with at least two hydroxyl groups thereof being protected with one protective group. Such feature can be further understood by reference to Nihon Kagakukai (ed.), Shin Jikken Kagaku Koza, Vol. 14, "Yuki Kagobutsu no Gosei to Han-no (V), p. 2505, Maruzen K.K., J. F. W. Mc. Omie, *Protective Groups in Organic Chemistry,* Chapters 3 and 4, Plenum Press, etc.

In Process (D), a monomer with at least two hydroxyl groups thereof protected in advance is synthesized by known processes as described in the above-cited references, and the resulting monomer is polymerized in a conventional manner, and, if desired, in the presence of other copolymerizable monomer(s) to prepare a homo- or copolymer.

The polymer according to the second embodiment has a molecular weight ranging from $10^3$ to $10^6$, and preferably from $5\times10^3$ to $10^5$. The content of the repeating unit containing the functional group is from 0.1 to 100% by weight, and preferably from 0.5 to 100% by weight, based on the total weight of the polymer.

Specific but non-limitative examples of the repeating unit having the functional group with at least two hydroxyl groups protected with one protective group are shown below.

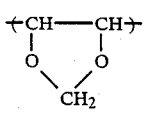

(1)

-continued

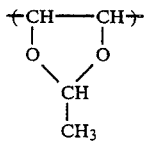

(2)

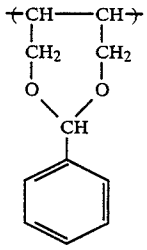

(3)

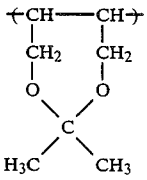

(4)

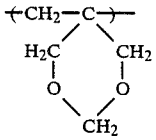

(5)

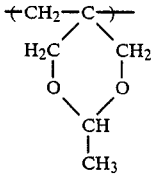

(6)

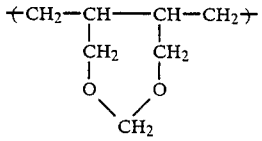

(7)

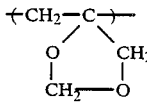

(8)

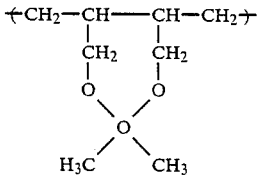

(9)

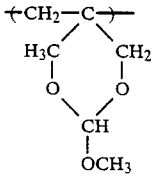

(10)

-continued (11)

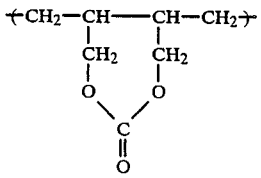

(12)

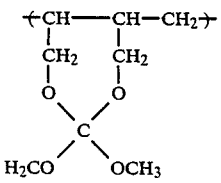

(13)

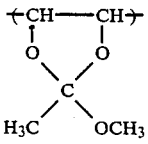

(14)

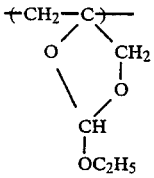

(15)

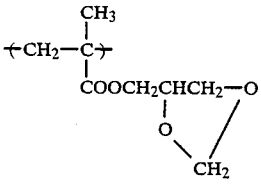

(16)

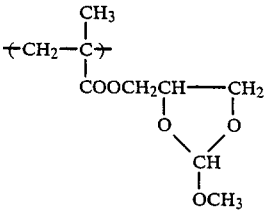

(17)

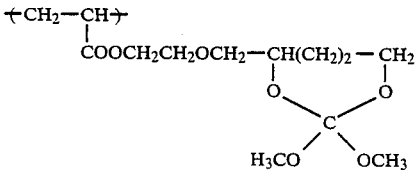

(18)

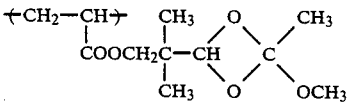

(19)

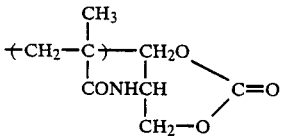

-continued (20)

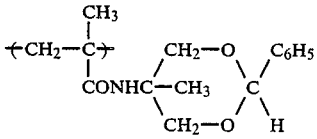

(21)

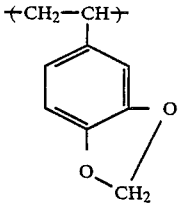

(22)

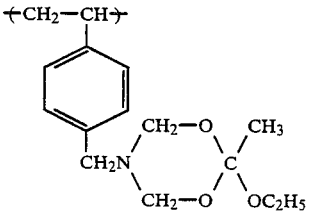

(23)

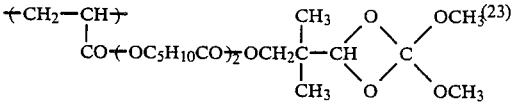

(24)

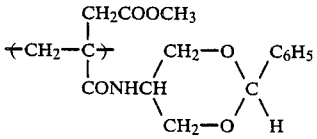

(25)

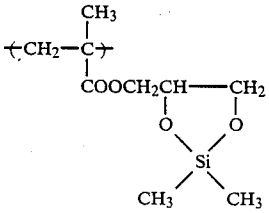

(26)

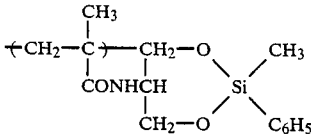

In the present invention, conventionally known resins may also be used as a binder in combination with the above-described resins according to the present invention. Such resins include silicone resins, alkyd resins, vinyl acetate resins, polyester resins, styrene-butadiene resins, acrylic resins, and the like. Specific examples of these resins are described, e.g., in T. Kurita et al., *Kobunshi,* Vol. 17, p. 278 (1968); H. Miyamoto et al., *Imaging,* No. 8, p. 8 (1973), etc.

The resin according to the present invention and the known resins may be used at optional mixing ratios, but, it is preferable that the resin of the invention, i.e., hydroxyl-forming functional group-containing resin, be used in an amount of from about 1 to 80% by weight based on the total resin. If the proportion of the resin of the invention is less than about 1% by weight, the resulting lithographic printing plate precursor tends to show reduced oil-desensitization when processed with an oil-desensitizing solution or moistening water, thus resulting in stain formation during printing. On the other hand, if it exceeds about 80% by weight, the resulting printing plate precursor tends to have deteriorated image-forming performances or the photoconductive layer tends to have reduced film strength, leading to deteriorated mechanical durability of the printing plate. Hence, the resin according to the present invention is preferably used in a proportion of from 5 to 40% by weight in the case of the resin containing the functional group of formula (I), or from 3 to 30% by weight in the case of the resin containing the functional group with at least two neighboring hydroxyl groups thereof being protected with one protective group, each based on the whole resin.

The resin according to the present invention which contains at least one functional group capable of forming a hydroxyl group is hydrolyzed or hydrogenolyzed upon contact with an oil-desensitizing solution or moistening water used on printing thereby to form a hydroxyl group. Therefore, when the resin is used as a binder for a lithographic printing plate precursor, hydrophilic properties of non-image areas attained by processing with an oil-desensitizing solution can be enhanced by the thus formed hydroxyl groups. As a result, a marked contrast can be provided between lipophilic properties of image areas and hydrophilic properties of non-image areas to prevent adhesion of a printing ink onto the non-image areas during printing. Thus, the provision of a lithographic printing plate capable of producing a large number of prints having a clear image free from background stains as compared with lithographic printing plates prepared by using conventional resin binders has now been realized.

In the case where conventional resin binders are employed in the production of lithographic printing plate precursors, the dispersion of zinc oxide in these resins results in increased viscosity so that the photoconductive layer formed by coating such a dispersion may tend to have seriously deteriorated smoothness or insufficient film strength, and may also be unsatisfactory in electrophotographic characteristics. Even if a printing plate precursor having sufficient smoothness might be obtained, stains tend to be formed during printing. Hydroxyl groups contained in the conventional resin may be adjusted so as to produce a printing plate precursor which can form a satisfactory image and provide a satisfactory print, but the image formed on the precursor is very sensitive to environmental influences. That is, if the environmental condition is changed during electro-photographic image formation processing to a low temperature and low humidity or high temperature and high humidity condition (particularly, to a high temperature and high humidity condition), the quality of the image formed suffers from deterioration due to formation of background fog, reduction in density of image areas, or disappearance of fine lines or letters.

These unfavorable phenomena which tend to accompany the conventional lithographic printing plate precursors are presumably attributed to the following reasons. Since the interaction between hydroxyl groups in the resin binder and surfaces of photoconductive zinc oxide particles is strong, the resin adsorption on the surfaces of zinc oxide particles increases. As a result, compatibility of the photoconductive layer with an oil-desensitizing solution or moistening water is impaired. Otherwise, even when the hydroxyl groups in the resin binder may be adjusted adequately with respect to zinc oxide particles, the hydrophilic environment at the boundaries between the hydroxyl groups in the resin and the zinc oxide particles greatly changes upon exposure to a low temperature and low-humidity condition or a high-temperature and high-humidity condition, so that electrophotographic characteristics, such as surface potential or dark decay after charging, and the like, are deteriorated.

The photoconductive layer of the lithographic printing plate precursor according to the present invention usually comprises from 10 to 60 parts by weight, and preferably from 15 to 30 parts by weight, of the resin binder per 100 parts by weight of -photoconductive zinc oxide. If desired, the photoconductive layer may further contain various additives known for electrophotographic light-sensitive layers, such as sensitizing dyes including xanthene dyes, cyanine dyes, etc. (e.g., Rose Bengal), chemical sensitizers, e.g., acid anhydrides, and the like. Specific examples of usable additives are described, e.g., in H. Miyamoto, et al., *Imaging*, No. 8, p. 12 (1973). The total amount of these additives ranges from 0.0005 to 2.0 parts by weight per 100 parts by weight of a photoconductive substance.

The photoconductive layer according to the present invention can be provided on any known support. In general, a support for an electrophotographic light-sensitive layer is preferably electrically conductive. Any of conventionally employed conductive supports may be utilized in this invention. Examples of usable conductive supports include a base, e.g., a metal sheet, paper, a plastic sheet, etc., having been rendered electrically conductive by, for example, impregnating with a low resistant substance; a base with the back side thereof (opposite to the light-sensitive layer side) being rendered conductive and further coated thereon at least one layer for the purpose of prevention of curling, etc.; the aforesaid supports having provided thereon a water-resistant adhesive layer; the aforesaid supports having provided thereon at least one precoat layer; paper laminated with a plastic film on which aluminum, etc., is deposited; and the like.

Specific examples of conductive supports and materials for imparting conductivity which can be used in the present invention are described in S. Sakamoto, Denshishashin, Vol. 54, No. 1, pp. 2 to 11 (1975); H. Moriga, Nyumon Tokushushi no Kagaku, Kobunshi Kankokai (1975); M.F. Hoover, *J. Macromol. Sci. Chem.*, A-4(6), pp. 1327 to 1417 (1970), etc.

The present invention is now illustrated in greater detail by way of examples, but it should be understood that the present invention is not limited thereto.

EXAMPLES 1 AND 2 AND COMPARATIVE EXAMPLES 1 TO 3

A mixed solution consisting of 36 g of n-butyl methacrylate, 54 g of ethyl methacrylate, 10 g of Compound (2), and 200 g of toluene was heated to 70° C. under a nitrogen stream, and 1.0 g of azobisisobutyronitrile (AIBN) was added thereto, followed by allowing reaction to occur for 8 hours. The resulting copolymer had a weight average molecular weight of 65000.

A mixture of 30 g (solid base) of the resulting copolymer, 10 g of a butyl methacrylate/acrylic acid copolymer (98/2 by weight; weight average molecular weight: 45,000), 200 g of zinc oxide, 0.05 g of Rose Bengal, 0.01 g of phthalic anhydride, and 300 g of toluene was dispersed in a ball mill for 2 hours to prepare a light-sensitive coating composition. The composition was coated on paper having been rendered conductive to a dry coverage of 25 g/m$^2$ with a wire bar coater, followed by drying at 110° C. for 1 minute. The support having formed thereon a light-sensitive layer was then allowed to stand in a dark place at 20° C. and 65% RH for 24 hours to produce an electrophotographic lithographic printing plate precursor. The resulting printing plate precursor was designated as Sample A.

Sample B was prepared in the same manner as described above except for replacing Compound (2) with 10 g of a monomer corresponding to Repeating Unit (15). The resulting copolymer had a weight average molecular weight of 56,000.

Comparative Samples C to E were produced in the same manner as for Sample A except for using copolymers shown below as a resin binder.

Sample C: A copolymer (weight average molecular weight: 65,000) prepared in the same manner as described for Sample A except for using a mixture consisting of 40 g of n-butyl methacrylate, 60 g of ethyl methacrylate, and 200 g of toluene.

Sample D: A copolymer (weight average molecular weight 63,000) prepared in the same manner as described for Sample A except for using a mixture consisting of 36 g of n-butyl methacrylate, 54 g of ethyl methacrylate, 10 g of 2-hydroxyethyl meth acrylate, and 200 g of toluene.

Sample E: A copolymer (weight average molecular weight: 61,000) prepared in the same manner as described for Sample A except for using a mixture consisting of 30 g of n-butyl methacrylate, 45 g of ethyl methacrylate, 25 g of 2-hydroxyethyl methacrylate, and 200 g of toluene.

Each of the resulting lithographic printing precursors (Samples A to E) was evaluated for film properties in terms of surface smoothness; electrostatic characteristics; oil-desensitivity of the photoconductive layer in terms of contact angle with water after oil-desensitization; reproduced image quality; and printing performances in terms of stain resistance in accordance with the following test methods.

1. Smoothness of Photoconductive Layer:

The smoothness (sec/cc) was measured by means of a Beck's smoothness tester manufactured by Kumagaya Riko K.K. under an air volume condition of 1 cc.

2. electrostatic Characteristics:

The sample was negatively charged by corona discharge to a voltage of 6 kV for 20 seconds in a dark room at 20° C. and 65% RH using a paper analyzer ("Paper Analyzer SP-428" manufactured by Kawaguchi Denki K.K.). After the elapse of 10 seconds from the end of the corona discharge, the surface potential $V_O$ was measured. Then, the photoconductive layer was irradiated with visible light at an illumination of 2.0 lux, and the time required for dark decay of the surface potential $V_O$ to one-tenth was measured to evaluate photosensitivity from an exposure $E_{1/10}$ (lux.sec).

3. Contact Angle with Water:

The sample was passed once through an etching processor using an oil-desensitizing solution ("ELP-E" produced by Fuji Photo Film Co., Ltd.) to render the surface of the photoconductive layer oil-desensitized. On the thus oil desensitized surface was placed a drop of 2 μl of distilled water, and the contact angle formed between the surface and water was measured by a goniometer.

4. Image Quality:

A printing plate was produced from the sample which had been allowed to stand under an ambient condition (30° C., 65% RH; Condition I) overnight, and an image was formed thereon using an automatic printing plate making machine "ELP 404V" (manufactured by Fuji Photo Film Co., Ltd.) which had also been allowed to stand under the same conditions as for the sample. The image formed on the resulting printing plate was visually evaluated in terms of fog and image quality. The evaluation was repeated in the same manner as described above except for allowing the sample and the printing plate making machine under a high temperature-high humidity condition (30° C., 80% RH; Condition II) overnight.

5. Stain Resistance:

The sample was processed with ELP 404V to form a toner image, and the surface of the photoconductive layer was subjected to oil-desensitization under the same conditions as in 3) above. The resulting printing plate was mounted on a printer "Hamada Star 800SX" (manufactured by Hamada Star K.K.), and printing was carried out on fine paper in a conventional manner (Condition I) to obtain 500 prints. All the resulting prints were visually evaluated for background stains. The same evaluation was repeated except for printing under several varying conditions, i.e., by using a 5-fold diluted oil-desensitizing solution and by using a 2-fold diluted moistening water for printing (Condition II).

The results of these evaluations are shown in Table 1 below.

TABLE 1

| | Example 1 | Example 2 | Comparative Example 1 | Comparative Example 2 | Comparative Example 3 |
|---|---|---|---|---|---|
| Sample No. | A | B | C | D | E |
| Surface Smoothness (Sec/cc) | 80 | 85 | 85 | 80 | 65 |
| Electrostatic Characteristics: | | | | | |
| $V_0$ (V) | 550 | 545 | 550 | 550 | 550 |
| $E_{1/10}$ (lux · sec) | 8 | 8 | 8 | 8.5 | 9.5 |
| Contact Angle with Water | 8° | 5° | 2.5° | 13° | 8°–20° (with great scatter) |
| Image Quality: | | | | | |
| Condition I | excellent | excellent | excellent | excellent | good |
| Condition II | excellent | excellent | excellent | poor | very poor |
| Background Stain Resistance: | | | | | |
| Condition I | excellent | excellent | poor | excellent | good |

TABLE 1-continued

| | Example 1 | Example 2 | Comparative Example 1 | Comparative Example 2 | Comparative Example 3 |
|---|---|---|---|---|---|
| Condition II | excellent | excellent | very poor | excellent | poor |

As can be seen from Table 1, Samples A, B, C, and D formed clear images, whereas Sample E had considerably deteriorated surface smoothness and the reproduced image was unclear due to fog on the non-image areas. When electrophotographically processed under Condition II (30° C., 80% RH), the images formed on Samples D and E were seriously deteriorated, i.e., background fog was formed, and the image density was reduced to 0.6 or even less. Samples A, B, and D having been oil-desensitized showed a contact angle with water of less than 15°, indicating sufficient hydrophilic properties.

When each of Samples A to E was used as master plate for offset printing, Samples A, B, and D did not form background stains on the non-image areas. When 10,000 prints were obtained, Samples A, B, and D did not suffer from background stains, whereas Samples C and E formed background stains.

From all these considerations, it is clear that only the printing plate precursors in accordance with the present invention (Samples A and B) can always form a clear image and produce more than 10,000 clear prints free from background stains even when processed under varied environmental conditions.

Further, when the printing plate precursors of the invention were subjected to the same testing procedures as described above after being allowed to stand for 2 weeks at 45° C. and 75% RH, no change in performance properties was observed at all.

EXAMPLE 3

A mixture consisting of 30 g of benzyl methacrylate, 45 g of ethyl methacrylate, 25 g of Compound (6), and 200 g of toluene was heated to 75° C. under a nitrogen stream, and 1.5 g of AIBN was added thereto, followed by allowing the mixture to react for 8 hours. The resulting copolymer had a weight average molecular weight of 43,000.

A lithographic printing plate precursor was produced in the same manner as in Example 1 except for using the thus prepared copolymer, and the resulting precursor was electrophotographically processed by ELP 404V. The resulting master plate for offset printing had a clear image having a density of 1.2 or more. After etching processing, the printing plate was mounted on a printing machine. When printing was carried out, more than 10,000 clear prints free from fog on the background were obtained.

After the printing plate precursor was allowed to stand for 2 weeks at 45° C. and 75% RH, the same evaluations as above were made, but no change in performance properties was observed.

EXAMPLE 4

A mixture consisting of 30 g of benzyl methacrylate, 45 g of ethyl methacrylate, 25 g of a monomer corresponding to Repeating Unit (23), and 200 g of toluene was heated to 75° C. under a nitrogen stream, and 1.0 g of AIBN was added thereto, followed by allowing the mixture to react for 8 hours. The resulting copolymer had a weight average molecular weight of 43,000.

A lithographic printing plate precursor was produced in the same manner as in Example 1 except for using the thus prepared copolymer, and the resulting plate precursor was processed by ELP 404V. The resulting master plate for offset printing had a clear image having a density of 1.2 or more. After etching processing, the printing plate was used for printing on a printing machine to obtain more than 10,000 clear prints free from fog on the background.

When the same evaluations as described above were repeated after the printing plate precursor was allowed to stand for 2 weeks at 45° C. and 75% RH, no change in performance properties was observed.

EXAMPLE 5

A mixture consisting of 16 g of styrene, 64 g of ethyl methacrylate, 20 g of Compound (7), 0.2 g of acrylic acid, and 200 g of toluene was heated to 75° C. under a nitrogen stream, and 1.0 g of AIBN was added thereto, followed by allowing the mixture to react for 8 hours. The resulting copolymer had a weight average molecular weight of 55,000.

A mixture of 40 g (solid base) of the resulting copolymer, 200 g of zinc oxide, 0.05 g of Rose Bengal, 0.01 g of phthalic anhydride, and 300 g of toluene was dispersed in the same manner as in Example 1 to prepare a light-sensitive coating composition. A lithographic printing plate precursor was produced in the same manner as in Example 1 except for using the resulting coating composition.

When the printing precursor was electrophotographically processed with ELP 404V, the resulting master plate for offset printing had a clear image having a density of 1.0 or more. After etching processing, printing was carried out to obtain more than 10,000 clear prints free from fog.

Further, when the same evaluations as above were repeated after the printing plate precursor was allowed to stand for 2 weeks at 45° C. and 75% RH, no change in performance properties was observed.

EXAMPLE 6

A mixture consisting of 16 g of styrene, 64 g of ethyl methacrylate, 20 g of a monomer corresponding to Repeating Unit (22), 0.2 g of acrylic acid, and 200 g of toluene was heated to 75° C. under a nitrogen stream, and 1.0 g of AIBN was added thereto, followed by allowing the mixture to react for 8 hours. The resulting copolymer had a weight average molecular weight of 55,000.

A mixture of 40 g (solid base) of the resulting copolymer, 200 g of zinc oxide, 0.05 g of Rose Bengal, 0.01 g of phthalic anhydride, and 300 g of toluene was dispersed in the same manner as in Example 1 to prepare a light-sensitive coating composition. A lithographic printing plate precursor was produced in the same manner as in Example 1 except for using the resulting coating composition. When the printing plate precursor was electrophotographically processed in the same manner as in Example 1, the resulting master plate for offset printing had a clear image having a density of 1.0 or more. After etching processing, the resulting printing plate was used for printing to obtain more than 10,000 clear prints free from fog.

When the same evaluations as described above were repeated after the printing plate precursor was allowed to stand for 2 weeks at 45° C. and 75% RH, no change in performance properties was observed.

EXAMPLE 7

A mixture consisting of 40 g of butyl vinyl ether, 10 g of 4-methylene-1,3-dioxoran, and 100 g of diethyl ether was cooled to −78° C. under a nitrogen stream, and 5 g of a boron trifluoride ethyl etherate was added thereto while stirring. After reacting for 60 hours, a methanolic solution of ammonia was added to the reaction mixture to terminate the reaction. The precipitated polymer was separated from the reaction mixture by decantation, washed with hexane, and dried under reduced pressure.

A mixture of 20 g (solid basis) of the resulting copolymer, 20 g of a butyl methacrylate/acrylic acid copolymer (99/1 by weight; weight average molecular weight: 65,000), 200 g of zinc oxide, 0.05 g of Rose Bengal, 0.01 g of phthalic anhydride, and 300 g of toluene was dispersed in the same manner as in Example 1 to prepare a light-sensitive coating composition. A printing plate precursor was produced in the same manner as in Example 1 except for using the resulting coating composition. When this printing plate precursor was electrophotographically processed in the same manner as in Example 1, the resulting master plate for offset printing had a clear image having a density of 1.0 or more. After etching processing, the printing plate was used for printing to obtain more than 10,000 clear prints free from fog.

When the same evaluations as above were repeated after the printing plate precursor was allowed to stand for 2 weeks at 45° C. and 75% RH, no change in performance properties was observed at all.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic element produced by a process comprising an electrophotographically imaging a lithographic printing plate precursor comprising a conductive support having provided thereon at least one photoconductive layer containing photoconductive zinc oxide and a resin binder followed by subjecting said photoconductive layer to an oil-desensitization treatment, wherein said resin binder comprises a resin containing at least one functional group per molecule thereof capable of forming at least one hydroxyl group upon being decomposed by said oil-desensitization treatment, wherein said resin contains at least one functional group per molecule thereof represented by formula (I):

$$-O-L \qquad \text{(I)}$$

wherein L represents $$-\overset{\overset{R_1}{|}}{\underset{\underset{R_3}{|}}{Si}}-R_2,\ -CO-Y_1,\ -CO-Z-Y_2,\ -CH=CH-CH_3,$$

-continued

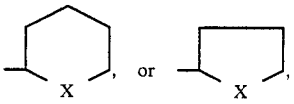

wherein $R_1$, $R_2$, and $R_3$ each represents a hydrogen atom, a hydrocarbon group, or —O—R′, wherein R′ represents a hydrocarbon group; X represents a sulfur atom or an oxygen atom; $Y_1$ represents a substituted straight chain or branched chain alkyl group having 1 to 6 carbon atoms; $Y_2$ represents a hydrocarbon group; and Z represents an oxygen atom, a sulfur atom or -NH- or wherein said resin contains at least one functional group in which at least two hydroxyl groups spaced sterically close together are protected with one protective group.

2. An electrophotographic lithographic element as in claim 1, wherein $R_1$, $R_1$, and $R_3$ each represents a hydrogen atom, a substituted or unsubstituted straight chain or branched chain alkyl group having from 1 to 18 carbon atoms, a substituted or unsubstituted alicyclic group, a substituted or unsubstituted aralkyl group having from 7 to 12 carbon atoms, a substituted or unsubstituted aryl group, or —O—R′, wherein R′ represents a substituted or unsubstituted straight chain or branched chain alkyl group having from 1 to 18 carbon atoms, a substituted or unsubstituted alicyclic group, a substituted or unsubstituted aralkyl group having from 7 to 12 carbon atoms, or a substituted or unsubstituted aryl group; $Y_1$ and $Y_2$ each represents a substituted or unsubstituted straight chain or branched chain alkyl group having from 1 to 6 carbon atoms, a substituted or unsubstituted aralkyl group having from 7 to 9 carbon atoms, or a substituted or unsubstituted aryl group having from 6 to 12 carbon atoms.

3. An electrophotographic lithographic element as in claim 2, wherein said resin is prepared by polymerizing at least one monomer containing at least one functional group of formula (I) or copolymerizing such a monomer with other copolymerizable monomers.

4. An electrophotographic lithographic element as in claim 3, wherein said monomer containing at least one functional group of formula (I) is represented by formula (II)

$$\overset{a_1}{\overset{|}{CH}}=\overset{a_2}{\overset{|}{\underset{\underset{X'-Y'-O-L}{|}}{C}}} \qquad \text{(II)}$$

wherein X′ represents $$-O-,\ -CO-,\ -COO-,\ -OCO-,\ -\overset{\overset{Q_1}{|}}{N}CO-,\ -CO\overset{\overset{Q_2}{|}}{N}-,$$

$$-SO_2-,\ -SO_2\overset{\overset{Q_3}{|}}{N}-,\ -\overset{\overset{Q_4}{|}}{N}SO_2-,\ -CH_2COO-,\ \left(\overset{\overset{b_1}{|}}{\underset{\underset{b_2}{|}}{C}}\right)_n,$$

an aromatic group, or a heterocyclic group, wherein $Q_1$, $Q_2$, $Q_3$, and $Q_4$ each represents a hydrogen atom, a hydrocarbon group, or the group —Y′—O—L in formula (II); $b_1$ and $b_2$ each represents a hydrogen atom, a hydrocarbon group, or the group —Y′—O—L in formula (II); and n represents an integer of from 0 to 18; Y′ represents a carbon-carbon bond linking X' and —O—L; L is as defined in claim 1; and $a_1$ and $a_2$ each represents a hydrogen atom, a hydrocarbon group, a hydroxyl group, or —COO—W, wherein W represents an alkyl, alkenyl, aralkyl, alicyclic, or aromatic group having from 1 to 18 carbon which may be substituted with a group containing the group —O—L.

5. An electrophotographic lithographic element as in claim 4, wherein Y' is composed of one or more of

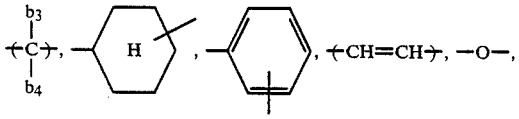

$$-S-,\ -\overset{b_5}{\overset{|}{N}}-,\ -COO-,\ -CONH-,\ -SO_2-,\ -SO_2NH-,$$

$$-NHCOO-,\ \text{and}\ -NHCONH-,$$

wherein $b_3$, $b_4$, and $b_5$ each has the same meaning as $b_1$ and $b_2$ of claim 5.

6. An electrophotographic lithographic element as in claim 3, wherein said monomer containing at least one functional group of formula (I) is present in an amount of from 0.5 to 99.5% by weight based on the total weight of the polymer.

7. An electrophotographic lithographic element as in claim 3, wherein said monomer containing at least one functional group of formula (I) is present in an amount of from 1 to 99% by weight based on the total weight of the polymer.

8. An electrophotographic lithographic element as in claim 1, wherein said resin has a molecular weight of from $10^3$ to $10^6$.

9. An electrophotographic lithographic element as in claim 1, wherein said resin has a molecular weight of from $5\times10^3$ to $5\times10^5$.

10. An electrophotographic lithographic element as in claim 1, wherein said functional group is selected from a group represented by formula (III)

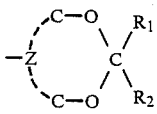

(III)

wherein $R_1$ and $R_2$ each represents a hydrogen atom, a hydrocarbon group, or —O—R', wherein R' represents a hydrocarbon group; and Z represents

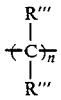

wherein R''' may be the same or different and represents a hydrogen atom or a hydrocarbon group and n is an integer of 1, 2 or 3; or a linking group composed of at least one

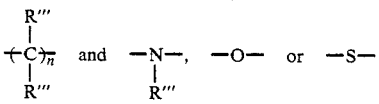

wherein R''' is as defined above, provided that the number of atoms existing between the two oxygen atoms in the formula does not exceed 5, a group represented by formula (IV)

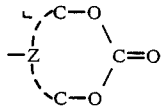

(IV)

wherein Z is the same as defined above and a group represented by formula (V)

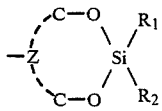

(V)

wherein $R_1$, $R_2$, and Z are the same as defined above.

11. An electrophotographic lithographic element as in claim 10, wherein $R_1$ and $R_2$ each represents a hydrogen atom, a substituted or unsubstituted alkyl group having from 1 to 12 carbon atoms, a substituted or unsubstituted aralkyl group having, from 7 to 9 carbon atoms, an alicyclic group having from 5 to 7 carbon atoms, a substituted or unsubstituted aryl group, or —O—R', wherein R' represents a substituted or unsubstituted alkyl group having from 1 to 12 carbon atoms, a substituted or unsubstituted aralkyl group having from 7 to 9 carbon atoms, an alicyclic group having from 5 to 7 carbon atoms, or a substituted or unsubstituted aryl group.

12. An electrophotographic lithographic element as in claim 1, wherein said resin is prepared by protecting two hydroxyl groups of a polymer, said hydroxyl groups being spaced sterically close together, with a protective group.

13. An electrophotographic lithographic element as in claim 1, wherein said resin is prepared by polymerizing at least one monomer containing two hydroxyl groups spaced sterically close together which have previously been protected with one protective group, or copolymerizing such a monomer with other copolymerizable monomers.

14. An electrophotographic lithographic printing plate precursor as in claim 1, wherein said resin comprises from 0.1 to 100% by weight of a monomer unit containing at least one functional group in which at least two hydroxyl groups spaced sterically close together are protected with one protective group.

15. An electrophotographic lithographic element as in claim 1, wherein said resin comprises from 0.5 to 100% by weight of a monomer unit containing at least one functional group in which at least two hydroxyl groups spaced sterically close together are protected with one protective group.

16. An electrophotographic lithographic element as in claim 1, wherein said resin has a molecular weight of from $10^3$ to $10^6$.

17. An electrophotographic lithographic element as in claim 1, wherein said resin has a molecular weight of from $5\times10^3$ to $5\times10^5$.

18. An electrophotographic lithographic element as in claim 1, wherein said resin is present in an amount of from 1 to 80% by weight based on the total weight of the resin binder.

19. An electrophotographic lithographic element as in claim 1, wherein said resin is present in an amount of from 5 to 40% by weight based on the total weight of the resin binder.

20. An electrophotographic lithographic element as in claim 1, wherein said resin is present in an amount of from 3 to 30% by weight based on the total weight of the resin binder.

21. An electrophotographic lithographic element as in claim 1, wherein said resin binder is present in an amount of from 10 to 60 parts by weight per 100 parts by weight of photoconductive zinc oxide.

22. An electrophotographic lithographic element as in claim 1, wherein said resin binder is present in an amount of from 15 to 30 parts by weight per 100 parts by weight of photoconductive zinc oxide.

23. An electrophotographic lithographic element as in claim 1, wherein $Y_1$ represents a trichloromethyl group, a trifluoromethyl group, a methoxymethyl group, a phenoxymethyl group, a 2,2,2-trifluoroethyl group or a hexafluoro-isopropyl group.

24. An electrophotographic lithographic element as in claim 1, wherein $Y_1$ represents a substituted phenyl group having 6 to 12 carbon atoms.

25. An electrophotographic lithographic element as in claim 24, wherein the substituted phenyl group is selected from the group consisting of a nitrophenyl group, a cyanophenyl group, a methanesulfonylphenyl group, a methoxyphenyl group, a butoxyphenyl group, a chlorophenyl group, a dichlorophenyl group and a trifluoromethylphenyl group.

26. An electrophotographic lithographic element as in claim 1, wherein L represents

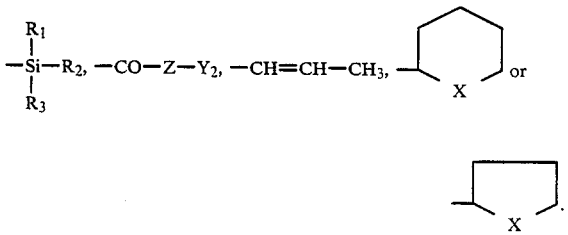

27. An electrophotographic lithographic element as in claim 1, wherein L represents $-CO-Y_1$.

28. A method for preparing a lithographic printing plate which comprises electrophotographically forming an image on an electrographic lithographic printing plate precursor and subjecting the printing plate precursor to an oil desensitization treatment, said electrophotographic lithographic printing plate precursor comprising a conductive support having provided thereon at least one photoconductive layer containing photoconductive zinc oxide and a resin binder, wherein said resin binder comprises a resin having a functional group which is capable of forming a hydroxyl group upon decomposition by the oil-desensitization treatment, wherein said resin contains at least one functional group per molecule thereof represented by formula (I):

$$-O-L \qquad (I)$$

wherein L represents

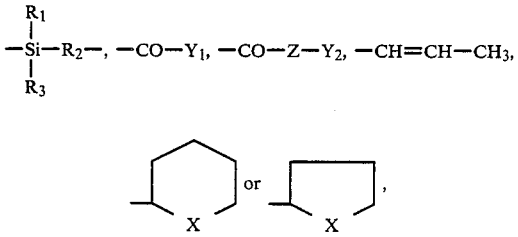

wherein $R_1$, $R_2$, and $R_3$ each represents a hydrogen atom, a hydrocarbon group, or —O—R′, wherein R′ represents a hydrogen group; X represents a sulfur atom or an oxygen atom; $Y_1$ represents a substituted straight chain or branched chain alkyl group having 1 to 6 carbon atoms; $Y_2$ represents a hydrocarbon group; and Z represents an oxygen atom, a sulfur atom or -NH- or wherein said resin contains at least one functional group in which at least two hydroxyl groups spaced sterically close together are protected with one protective group.

29. A method for preparing an electrophotographic lithographic element as in claim 18, wherein $R_1$, $R_2$ and $R_3$ each represents a hydrogen atom a substituted or unsubstituted straight chain or branched chain alkyl group having from 1 to 18 carbon atoms, a substituted or unsubstituted alicylic group, a substituted or unsubstituted aralkyl group having from 7 to 12 carbon atoms, a substituted or unsubstituted aryl group, or —O—R′, wherein R′ represents a substituted or unsubstituted straight chain or branched chain alkyl group having 1 to 18 carbon atoms, a substituted or unsubstituted aralkyl group having from 7 to 12 carbon atoms, or a substituted or unsubstituted aryl group; $Y_1$ and $Y_2$ each represents a substituted or unsubstituted straight chain or branched chain alkyl group having from 1 to 6 carbon atoms, a substituted or unsubstituted aralkyl group having from 7 to 9 carbon atoms, or a substituted or unsubstituted aryl group having from 6 to 12 carbon atoms.

30. A method for preparing an electrophotographic lithographic element as in claim 18, wherein said resin is prepared by polymerizing at least one monomer containing at least one functional group of formula (I) or copolymerizing such a monomer with other copolymerizable monomers.

31. A method for preparing an electrophotographic lithographic element as in claim 30, wherein said monomer containing at least one functional group of formula (I) is represented by formula (II)

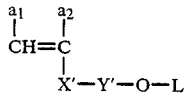

$$\qquad (II)$$

wherein X′ represents

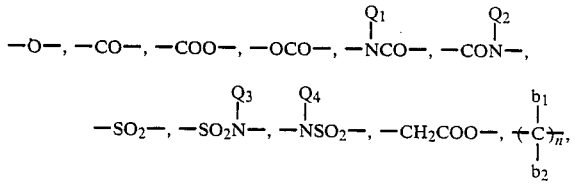

an aromatic group, or a heterocyclic group, wherein $Q_1$, $Q_2$, $Q_3$ and $Q_4$ each represents a hydrogen atom, a hydrocarbon group, or the group —Y'—O—L in formula (II); $b_1$ and $b_2$ each represents a hydrogen atom, a hydrocarbon group, or the group —Y'—O—L in formula (11); and n represents an integer of from 0 to 18; Y' represents a carbon-carbon bond linking X' and —O—L; L is as defined in claim 1; and $a_1$ and $a_2$ each represents a hydrogen atom, a hydrocarbon group, a hydroxyl group, or —COO—W, wherein W represents an alkyl, alkenyl, aralkyl, alicylic, or aromatic group having from 1 to 18 carbon which may be substituted with a group containing the group —O—L.

32. A method for preparing an electrophotographic lithographic element as in claim 31, wherein Y' is composed of one or more of

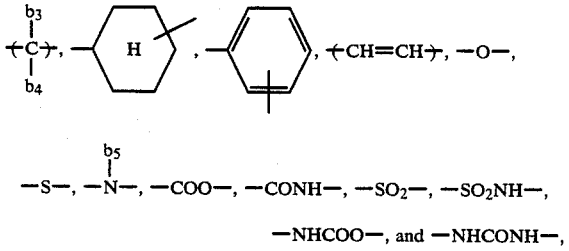

wherein $b_3$, $b_4$ and $b_5$ each has the same meaning as $b_1$ and $b_2$ of claim 31.

33. A method for preparing an electrophotographic lithographic element as in claim 30, wherein said monomer containing at least one functional group of formula (I) is present in an amount of from 0.5 to 99.5% by weight based on the total weight of the polymer.

34. A method for preparing an electrophotographic lithographic element as in claim 30, wherein said monomer containing at least one functional group of formula (I) is present in an amount of from 1 to 99% by weight based on the total weight of the polymer.

35. An electrophotographic lithographic element as in claim 28, wherein said resin has a molecular weight of from $10^3$ to $10^6$.

36. A method for preparing an electrophotographic lithographic element as in claim 18, wherein said resin has a molecular weight of from $5\times10^3$ to $5\times10^5$.

37. A method for preparing an electrophotographic lithographic element as in claim 28, wherein said functional group is selected from a group represented by formula (III)

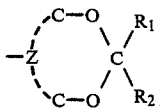

(III)

wherein $R_1$ and $R_2$ each represents a hydrogen atom, a hydrocarbon group, or —O—R', wherein R' represents a hydrocarbon group; and Z represents

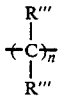

wherein R''' may be the same or different and represents a hydrogen atom or a hydrocarbon group and n is an integer of 1, 2 or 3; or a linking group composed of at least one

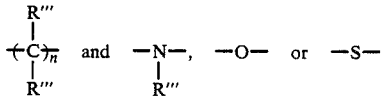

wherein R''' is as defined above, provided that the number of atoms existing between the two oxygen atoms in the formula does not exceed 5, a group represented by formula (IV)

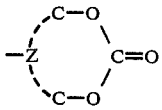

(IV)

wherein Z is the same as defined above and a group represented by formula (V)

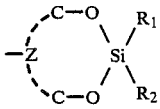

(V)

wherein $R_1$, $R_2$ and Z are the same as defined above.

38. A method for preparing an electrophotographic lithographic element as in claim 37, wherein $R_1$ and $R_2$ each represents a hydrogen atom, a substituted or unsubstituted alkyl group having from 1 to 12 carbon atoms, a substituted or unsubstituted aralkyl group having from 7 to 9 carbon atoms, an alicylic group having from 5 to 7 carbon atoms, a substituted or unsubstituted aryl group, or —O—R', wherein R' represents a substituted or unsubstituted alkyl group having from 1 to 12 carbon atoms, a substituted or unsubstituted aralkyl group having from 7 to 9 carbon atoms, an alicylic group having from 5 to 7 carbon atoms, or a substituted or unsubstituted aryl group.

39. A method for preparing an electrophotographic lithographic element as in claim 28, wherein said resin is prepared by protecting two hydroxyl groups of a polymer, said hydroxyl groups being spaced sterically close together, with a protective group.

40. A method for preparing an electrophotographic lithographic element as in claim 28, wherein said resin is prepared by polymerizing at least one monomer containing two hydroxyl groups spaced sterically close together which have previously been protected with one protective group, or copolymerizing such a monomer with other copolymerizable monomers.

41. A method for preparing an electrophotographic lithographic element as in claim 28, wherein said resin comprises from 0.1 to 100% by weight of a monomer unit containing at least one functional group in which at least two hydroxyl groups spaced sterically close together are protected with one protective group.

42. A method for preparing an electrophotographic lithographic element as in claim 28, wherein said resin comprises from 0.5 to 100% by weight of a monomer unit containing at least one functional group in which at least two hydroxyl groups spaced sterically close together are protected with one protective group.

43. A method for preparing an electrophotographic lithographic element as in claim 28, wherein said resin has a molecular weight of from $10^3$ to $10^6$.

44. A method for preparing an electrophotographic lithographic element as in claim 28, wherein said resin has a molecular weight of from $5\times10^3$ to $5\times10^5$.

45. A method for preparing an electrophotographic lithographic element as in claim 28, wherein said resin is present in an amount of from 1 to 80% by weight based on the total weight of the resin binder.

46. A method for preparing an electrophotographic lithographic element as in claim 28, wherein said resin is present in an amount of from 5 to 40% by weight based on the total weight of the resin binder.

47. A method for preparing an electrophotographic lithographic element as in claim 28, wherein said resin is present in an amount of from 3 to 30% by weight based on the total weight of the resin binder.

48. A method for preparing an electrophotographic lithographic element as in claim 28, wherein said resin binder is present in an amount of from 10 to 60 parts by weight per 100 parts by weight of photoconductive zinc oxide.

49. A method for preparing an electrophotographic lithographic element as in claim 28, wherein said resin binder is present in an amount of from 15 to 30 parts by weight per 100 parts by weight of photoconductive zinc oxide.

50. A method for preparing an electrophotographic lithographic element as in claim 28, wherein $Y_1$ represents a trichloromethyl group, a trifluoromethyl group, a methoxymethyl group, a phenoxymethyl group, a 2,2,2-trifluoroethyl group or a hexafluoro-isopropyl group.

51. A method for preparing an electrophotographic lithographic element as in claim 28, wherein $Y_1$ represents a substituted phenyl group having 6 to 12 carbon atoms.

52. A method for preparing an electrophotographic lithographic element as in claim 51, wherein the substituted phenyl group is selected from the group consisting of a nitrophenyl group, a cyanophenyl group, a methanesulfonylphenyl group, a methoxyphenyl group, a butoxyphenyl group, a chlorophenyl group, a dichlorophenyl group and a trifluoromethylphenyl group.

53. A method for preparing an electrophotographic lithographic element as in claim 28, wherein L represents

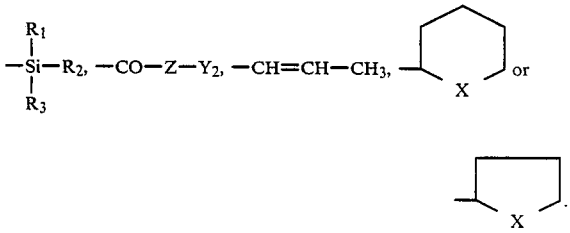

54. A method for preparing an electrophotographic lithographic element as in claim 28, wherein L represents —CO—$Y_1$.

* * * * *